US006213851B1

(12) United States Patent
Garcia et al.

(10) Patent No.: US 6,213,851 B1
(45) **Date of Patent: *Apr. 10, 2001**

(54) ABRADING APPARATUS

(75) Inventors: Jaime E. Garcia, Wexford, PA (US); Randall W. Barta, Lewistown, MT (US)

(73) Assignee: Delta International Machinery Corp., Pittsburgh, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/111,216

(22) Filed: Jul. 7, 1998

(51) Int. Cl.[7] ..... B24B 7/00
(52) U.S. Cl. ..... 451/270; 451/406
(58) Field of Search ..... 451/270, 271, 451/406, 282

(56) References Cited

U.S. PATENT DOCUMENTS

| | | | | |
|---|---|---|---|---|
| 2,000,667 | * | 5/1935 | Osterholm | 51/110 |
| 2,645,886 | * | 7/1953 | Peterson | 51/54 |
| 2,753,668 | * | 7/1956 | Strnad | 51/128 |
| 3,063,204 | | 11/1962 | Baumgartner . | |
| 3,137,977 | | 6/1964 | Graves . | |
| 3,287,859 | | 11/1966 | Leveque . | |
| 3,961,449 | * | 6/1976 | Ise | 51/128 |
| 4,030,250 | * | 6/1977 | Walker | 51/128 |
| 4,291,502 | | 9/1981 | Grimsby et al. . | |
| 4,322,921 | * | 4/1982 | Maier | 51/170 MT |
| 4,727,682 | | 3/1988 | Stäbler et al. . | |
| 4,729,194 | | 3/1988 | Maier et al. . | |
| 4,729,195 | | 3/1988 | Berger . | |
| 4,754,575 | | 7/1988 | Schneider . | |
| 4,759,152 | * | 7/1988 | Berger et al. | 51/120 |
| 4,854,085 | * | 8/1989 | Huber | 51/170 MT |
| 4,918,868 | | 4/1990 | Barth et al. . | |
| 4,979,334 | * | 12/1990 | Takahashi | 51/120 |
| 5,018,314 | | 5/1991 | Fushiya et al. . | |
| 5,018,588 | | 5/1991 | Haberer . | |
| 5,040,340 | | 8/1991 | Bischof et al. . | |
| 5,170,588 | | 12/1992 | Schaal et al. . | |
| 5,261,190 | | 11/1993 | Berger et al. . | |
| 5,317,838 | | 6/1994 | Bourner . | |
| 5,392,568 | | 2/1995 | Howard, Jr. et al. . | |
| 5,419,737 | | 5/1995 | Brazell et al. . | |
| 5,425,666 | * | 6/1995 | Frank et al. | 451/344 |
| 5,453,040 | | 9/1995 | Schaal et al. . | |
| 5,496,207 | * | 3/1996 | Hornung et al. | 451/357 |

(List continued on next page.)

FOREIGN PATENT DOCUMENTS

WO 90/09896 9/1990 (WO) .

OTHER PUBLICATIONS

*Fine Woodworking* Jan./Feb. 1992, by Sven Hanson, "Sanding discs: Adhesive back vs. hook and loop",pp. 47–51, and "Putting You Angle Grinder Into Orbit", p. 51.

Bosch Random Disc Sander/Polisher Operating Instructions, Model 1370 DEVS.

*Primary Examiner*—Timothy V. Eley
*Assistant Examiner*—Dung Van Nguyen
(74) *Attorney, Agent, or Firm*—Kirkpatrick & Lockhart LLP

(57) ABSTRACT

An eccentric orbit abrading apparatus includes a housing having a base for supporting the abrading apparatus on a surface. A workpiece support member is mounted on the housing and provides a surface for supporting the workpiece thereon. A motor is mounted in the housing and includes a motor shaft that may selectively rotate about a first rotational axis. A transmission transmits the rotational motion of the motor shaft to a platen so that as the motor shaft rotates, the platen is caused to rotate about a second rotational axis that is offset from and orbits about the first rotational axis.

41 Claims, 10 Drawing Sheets

U.S. PATENT DOCUMENTS 5,518,442 5/1996 Clowers et al. .
5,580,302 12/1996 Howard, Jr. et al. .
5,582,534 12/1996 Shendon et al. .
5,823,862 * 10/1998 Heidelberger ..... 451/344
5,879,225 * 3/1999 Kudo et al. ..... 451/271

* cited by examiner

ABRADING APPARATUS

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD AND INDUSTRIAL APPLICABILITY OF THE INVENTION

The present invention relates to an apparatus for abrading material from a workpiece, and more particularly relates to an abrading apparatus for woodworking and metal working applications. The present invention even more particularly relates to an improved eccentric orbit sanding and grinding apparatus. The present invention finds application in woodworking, metalworking, and in other fields wherein material is abraded by sanding or grinding a workpiece. Examples of woodworking and metal working applications in which the present invention may be used include smoothing or shaping wooden workpieces and deburring metal workpieces.

BACKGROUND OF THE INVENTION

Description of the Invention Background

As is known in the art, powered eccentric orbit sanding and grinding devices provide a means for sanding and grinding the surfaces of workpieces of various types of material. Sanding and grinding, as well as other similar operations wherein material is removed from a surface of a workpiece are collectively referred to herein as "abrading". Also, as used herein, an "eccentric orbit" sanding or grinding device is one having an abrading surface for removing material from a workpiece and the abrading surface both rotates and orbits simultaneously. More specifically, the abrading surface rotates about a rotational axis, and the rotational axis simultaneously orbits about a point offset from the rotational axis. As a point of reference only, the combined rotational and orbital motions of the abrading surface of an eccentric orbit abrading device may be compared generally with the motion of the Earth, which rotates about its axis while also orbiting about the Sun.

The combination of rotational and orbital motions of the abrading surface of an eccentric orbit abrading device is advantageous for at least the reason that during use a point on the abrading surface is less likely to describe a repeat pattern relative to the abraded surface of the workpiece than, for example, a point on the belt of a belt sander or the abrading disk of a disk sander in which the disk rotates about an axis which does not orbit about an offset point. If the abrading surface of an abrading device contacts the workpiece and a point on the abrading surface describes a repeat pattern on the workpiece, sand grains or other particles of abrasive material resident on the abrading surface may leave grooves, indentations, or other unsightly lines on the workpiece and mar its surface finish. Familiar examples of abrading devices having abrading surfaces that have a high tendency to generate repeat patterns include rotational disk sanders (that is, rotating sanders that do not provide for orbital motion of the rotational axis of the abrading surface) and powered belt sanders. The combined rotational and orbital motions of the abrading surface of an eccentric orbit abrading device may reduce the occurrence of such unsightly lines because the more complex motion described by a point on the abrading surface lessens the likelihood that repeated patterns will occur.

A subset of eccentric orbit abrading devices are the random orbit abrading devices. The abrading surface of random orbit abrading devices also moves in a combined rotational/orbital motion as described above, but the abrading surface freely rotates about the above-described rotational axis and is not positively driven to rotate. If left unchecked, the impulse imparted to the abrading surface as it orbits around the point offset from the surface's rotational axis causes the abrading surface to rotate about the rotational axis, and the rate of rotation of the abrading surface about the rotational axis may match the rate at which the abrading surface orbits about the axis point offset from the rotational axis. Reaching such a rotational rate is facilitated by, for example, mounting the abrading pad on a shaft that is received by low friction bearings. The shaft then defines the rotational axis and a means is provided for imparting the orbital motion to the surface. As the abrading surface contacts the workpiece with varying pressures, the frictional forces generated against the surface's rotation will vary the rotational speed of the pad and will prevent it from approaching the surface's orbital speed. The abrading surface's combined varying rotational speed and relatively constant orbital speed results in the random movement of points on the abrading surface, and this feature of random orbit abrading devices further reduces the possibility of sanding lines or other indentations being generated during the abrading operation. When sufficiently random, the action of a powered abrading device may simulate hand sanding, but will remove material from the workpiece at a substantially greater rate and will significantly speed the abrading operation.

A variety of hand -held eccentric and random orbit abrading devices are known in the art. Such known devices typically incorporate an arrangement of two disc members driven by a motor shaft. The motor shaft is coupled to a small electric drive motor, thus providing for hand-held operation of the device. Typically, a first disc member is coupled to the motor shaft and rotates with the motor shaft. The motor shaft thereby defines a rotational axis for the first disc member. A second disc member is rotatably mounted on the first disc member, typically received in low friction bearings, so as to substantially freely rotate relative to the first disc member. The second disc member's rotational axis is offset from the rotational axis of the first disc member. By this arrangement of elements, the second disc member may both rotate about its own rotational axis and revolve or "orbit" about the rotational axis defined by the motor shaft, thereby providing the second disc member, to which abrasive material is mounted, with the aforementioned combined rotational and orbital motions. As noted, if the second disc member may freely rotate about its rotational axis, the movement of points on the abrading surface will be random in use, and such random movement will significantly reduce the likelihood of scarring or gouging of the workpiece caused by the generation of repeat patterns.

The known hand-held eccentric and random orbit abrading devices are subject to several inherent shortcomings. For example, when working with relatively small wooden workpieces, the operator of hand-held eccentric or random orbit sanding devices typically may operate the device with one hand while manipulating and adjusting the orientation of the workpiece with the other hand. In such circumstances, it may be difficult to steady the workpiece, and safety concerns also arise because of the risk that the operator's hand may contact the driven sanding surface, resulting in possible injury. Additionally, the known handheld eccentric or random orbit sanding devices provide little or no precision in the control of the angle at which the workpiece contacts the device's sanding surface. Such a drawback is particularly troublesome when sanding small or easily abraded workpieces or when sanding adjacent workpiece surfaces that meet at an angle which the operator wishes to maintain in the finished article.

To address the foregoing shortcomings of the known hand-held eccentric and random orbit abrading devices, additional equipment such as a jig or vise have been used to immobilize the workpiece in a desired orientation and allow the operator to use both hands to manipulate the abrading device. Certain jigs or vises also have been employed to ensure that the abrading surface of hand-held abrading devices contact the workpieces at specific angles. The jigs and vises require additional expense, require time for proper mounting of the workpiece, exert pressure on the workpiece that may mar its surface, and significantly complicate the abrading process.

A further drawback of known hand-held eccentric and random orbit abrading devices is that as they approach a particular size and/or weight, they become difficult or impossible to use. An operator cannot readily manipulate large and/or heavy hand-held devices, and the vibrations and inertial forces generated by the combined rotational and orbital movements of the abrading surface makes the steady handling and accurate positioning of the device relative to the workpiece increasingly difficult. Certain known hand-held eccentric and random orbit abrading devices incorporate counterbalance weight means that will to some extent offset the vibrational forces generated by the eccentric rotation of the abrading surface about the motor shaft. However, as the size of the abrading surface of such devices becomes greater, the vibrational forces generated as the abrading surface eccentrically rotates about the motor shaft become increasingly significant. Dampening of such forces by counterbalance weight means eventually becomes impractical because the weight means significantly augments the weight of the device.

Accordingly, considering the deficiencies of the known hand-held eccentric orbit abrading devices, the need exists for an improved eccentric orbit abrading apparatus.

SUMMARY OF THE INVENTION

The present invention provides an abrading apparatus that includes a housing having a base for supporting the housing on a surface. The abrading apparatus also includes a workpiece support member that is mounted on the housing and that is for supporting a workpiece on the abrading apparatus. A motor is mounted within the housing and includes a motor shaft that may be selectively rotated about a first rotational axis. The abrading apparatus also includes a platen and a transmission for transmitting rotational motion of the motor shaft to the platen so that as the motor shaft rotates, the platen is urged to rotate about a second rotational axis. The second rotational axis, about which the platen rotates, is offset from and orbits about the first rotational axis. The first and second rotational axes may be generally parallel.

The transmission of the abrading apparatus of the present invention may include an intermediate member that is connected to the motor shaft and may rotate about the first rotational axis as the motor shaft rotates, and the intermediate member may also include a mounting structure that defines the second rotational axis. The mounting structure optionally may include a spindle to which the platen is operably mounted and on which the platen is rotatable so that an axis of the spindle defines the second rotational axis, about which the platen may rotate.

The intermediate member also may include a motor shaft mounting bore for accepting at least a portion of the motor shaft so as to connect the motor shaft to the intermediate member. In that form, an axis of the motor shaft mounting bore is coincident with the first rotational axis, the motor shaft mounting bore extends into the spindle, and the spindle is configured so that it provides a central axis coincident with the second rotational axis. The perimeter of a cross-section of the spindle preferably is generally circular, and the abrading apparatus preferably also includes a platen support for mounting the platen on the spindle so that the platen support is connected to the platen and includes a spindle receiving bore, and at least a portion of the spindle is disposed within the spindle receiving bore so that the platen support may rotate about the spindle. One or more friction reducing members such as, for example, roller bearings, may be included in connection with the platen support and/or the spindle so as to facilitate rotation of the platen support on the spindle.

The platen preferably has an abrasive member mounted on a surface of the platen, and the abrasive member includes an abrasive surface for abrading material from a workpiece as the platen rotates about the second rotational axis and orbits about the first rotational axis. The abrasive member may be directly attached to a surface of the platen or one or more intermediate members may be used to facilitate securely connecting the abrasive member to the platen.

The workpiece support member of the present abrading apparatus preferably borders on at least a portion of the platen, and the workpiece support member may include a workpiece supporting surface that is generally co-planer with the abrasive surface of the abrasive member. The abrading apparatus also may include a fence member that may be mounted on, for example, the workpiece support member and that is provided with a fence surface for partially supporting a workpiece on the abrading apparatus in a desired orientation relative to the abrasive member. In one form, the fence member may be adjustable so that an angle formed by a surface of the fence member and a surface of the workpiece support member may be adjusted.

The abrading apparatus of the present invention also may include a positive drive feature to urge the platen to rotate about the second rotational axis as the transmission causes the second rotational axis to orbit about the first rotational axis. The positive drive feature optionally includes a first drive member in the form of a first ring having a generally circular perimeter and that is mounted on the base so that a central axis of the first ring generally coincides with the first rotational axis. The positive drive feature also may include a second drive member in the form of a second ring with a generally circular perimeter and that is fixedly mounted on the platen so that a central axis of the second ring generally coincides with the second rotational axis. The inner perimeter of the first ring is greater than an outer perimeter of the second ring, and the second ring is positioned within and rolls along the inner circumference of the first ring so that at least a point on the outer circumference of the second ring contacts the inner circumference of the first ring as the second rotational axis orbits about the first rotational axis. By this arrangement, the platen is urged to rotate about the second rotational axis in an angular direction that is opposite to an angular direction of rotation of the motor shaft about the first rotational axis.

The abrading apparatus of the present invention also optionally includes an abraded matter collection system for removing at least a portion of the abraded matter from the vicinity of the abrading member disposed on the platen. In one form, the dust collection system includes vanes radially extending from a portion of the above-discussed intermediate member, and the vanes are disposed within an air guide cavity within the housing. The air guide cavity is in communication with the workpiece support surface (i.e., a pathway exists between the air guide cavity and the workpiece support surface), and the air guide cavity also includes an exhaust port for allowing air and matter entrained by the flow of air to exit from the air guide cavity. Rotation of the intermediate member about the first rotational axis forces air through the exhaust port of the air guide cavity and reduces pressure within the cavity, thereby pulling air from the vicinity of the workpiece support surface, along with entrained matter, into the air guide cavity and through the exhaust port.

The present invention also is directed to an abrading apparatus that includes a base for supporting the apparatus on a surface, a housing that is connected to the base, and a workpiece support member that is mounted on the housing. A motor is connected to or mounted on the housing and includes a motor shaft that may selectively rotate on a first axis of rotation. A platen is also provided that is rotatable on a second axis of rotation. The second axis of rotation differs from the first axis of rotation. The platen is coupled to the motor shaft by a transmission that causes the second axis of rotation to orbit in a circular path about the first axis of rotation as the motor shaft rotates. The abrading apparatus may include a positive drive for urging the platen to rotate in a second angular direction on the second axis of rotation as the motor shaft rotates on the first axis of rotation in a first angular direction, the first angular direction of rotation being opposite to the second angular direction of rotation. The positive drive system may include a first drive member having an inner void of a generally circular perimeter. The first drive member is connected to the base so that the central axis of the inner void generally coincides with the first axis of rotation of the abrading apparatus. The positive drive system also includes a second drive member that has a generally circular outer perimeter and that is fixedly mounted on the platen. The second drive member include a central axis that generally coincides with the second axis of rotation, and the generally circular perimeter of the inner void of the first drive member is greater than the generally circular outer perimeter of the second drive member. The second drive member is positioned within the inner void and is capable of rolling along the generally circular perimeter of the inner void as the second axis of rotation orbits about the first axis of rotation. The positive drive system may be configured so that at least a point on the generally circular outer perimeter of the second drive member contacts the generally circular perimeter of the inner void of the first drive member as the second axis of rotation orbits about the first axis of rotation so as to urge the platen to rotate on the second axis of rotation in an angular direction that is opposite to an angular direction of rotation of the motor shaft on the first axis of rotation.

The present invention additionally is directed to an abrading apparatus for abrading material from a workpiece and that include a housing and a base connected to the housing and for positioning the housing on a surface so that an operator may abrade material from the workpiece without the need for manipulating the position of the abrading apparatus. A workpiece support is connected to the housing for supporting the workpiece, and the abrading apparatus also includes a rotatable platen and motor mounted on the housing. The motor includes a motor shaft that may rotate about a first axis of rotation. A transmission is provided that connects to the platen and to the motor shaft and that transmits the rotation of the motor shaft to the platen. The platen is rotatable about a second axis of rotation that is defined by the transmission, and the second axis of rotation is offset from the first axis of rotation and also orbits about the first axis of rotation as the motor shaft rotates.

The present invention is further directed to an abrading apparatus for abrading material from a workpiece and that includes a housing, means for positioning the housing on a surface, a workpiece support that is connected to the housing for supporting a workpiece on the apparatus, and a platen that is rotatable about an axis of rotation. A motor having a rotatable motor shaft is also provided, and a transmission couples the motor shaft and the platen and urges the axis of rotation of the platen to orbit about a point as the motor shaft rotates. The point may lie on a line that is coincident with an axis of rotation of the motor shaft.

The abrading apparatus of the present invention may be positioned on a surface such as, for example, a work bench or a stand or other dedicated support structure. The platen may rotate and also orbit so as to provide the advantages of a combined rotational/orbital motion that will decrease the tendency for a point on the abrading member of the abrading apparatus to move in a repeat pattern that may mar the surface of the workpiece. Because the abrading apparatus of the present invention is self-supporting, it need not be manipulated by hand as is required with the existing eccentric orbit sanding and grinding apparatuses, all of which are hand-held. Thus, the operator's hands will be free to manipulate the workpiece and, consequently, fine detail work may be performed with greater ease relative to existing devices. Small workpieces also may be manipulated by both of the operator's hands when using the present abrading apparatus, and the possibility of the operator's hands contacting the driven abrading member is lessened. Also, angles, curves, and other complicated surface forms may be abraded with greater ease than with the existing, hand-held eccentric orbit sanding and grinding apparatuses, all of which require that the operator either hold the workpiece in one hand or place the workpiece in a vise or other like device while manipulating the abrading apparatus with his or her one or two free hands.

Accordingly, the present invention provides an improved abrading apparatus that addresses certain deficiencies associated with existing abrading devices. These and other details, objects, and advantages will become apparent as the following detailed description of embodiments of the present invention proceeds.

BRIEF DESCRIPTION OF THE DRAWINGS

In the accompanying drawings, preferred embodiments of the present invention are shown, wherein like reference numerals are employed to designate like parts and wherein.

DETAILED DESCRIPTION OF EMBODIMENTS OF THE INVENTION

Figure 1:
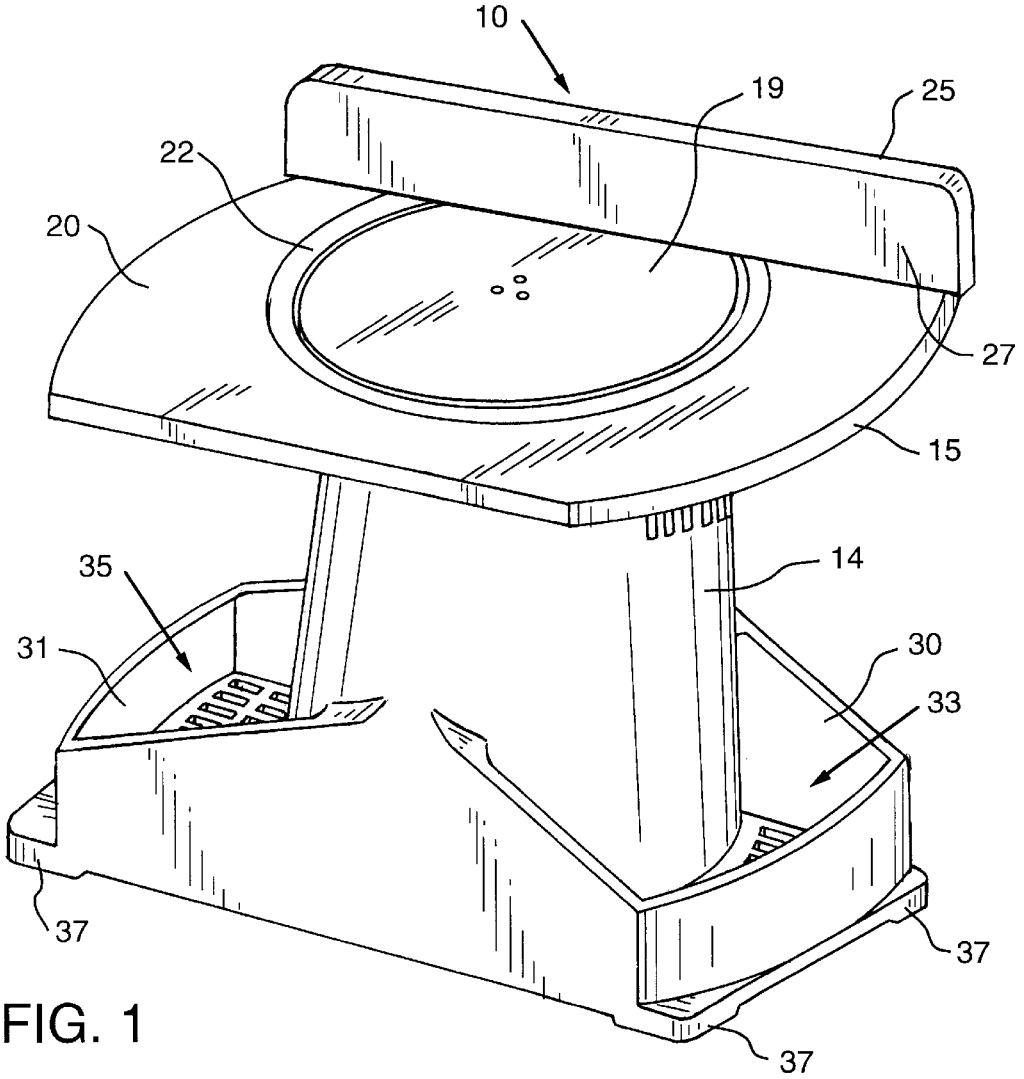
FIG. 1 is a front perspective view of an embodiment of the apparatus of the present invention.
Figure 2:
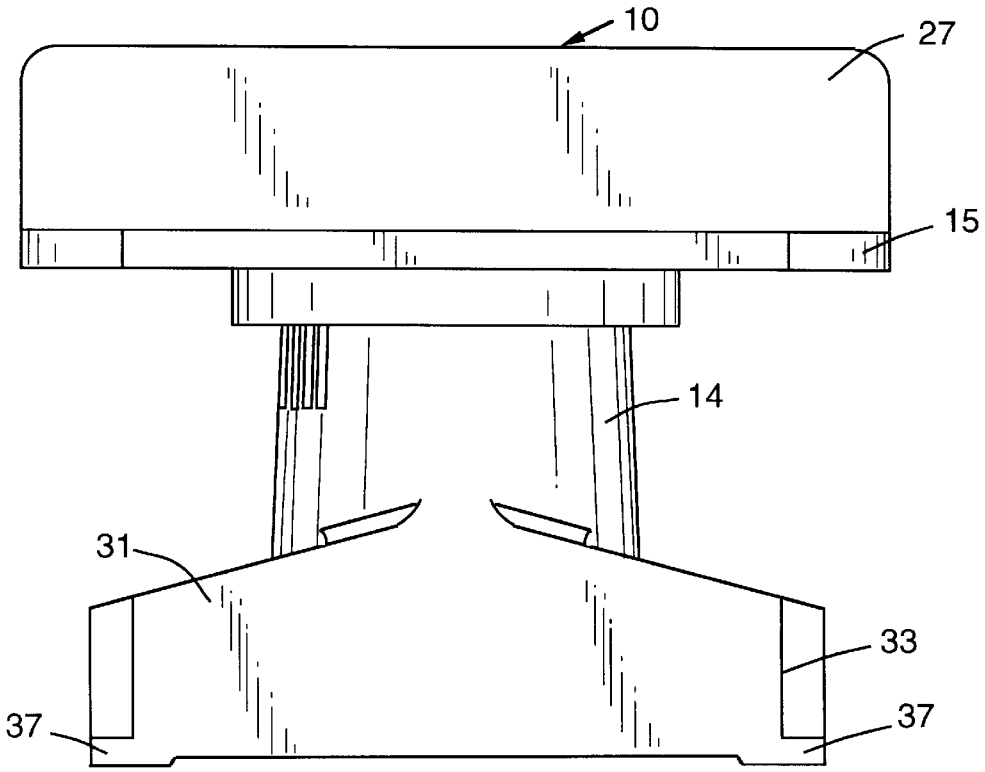
FIG. 2 is a front elevational view of the embodiment depicted in FIG. 1.
Figure 3:
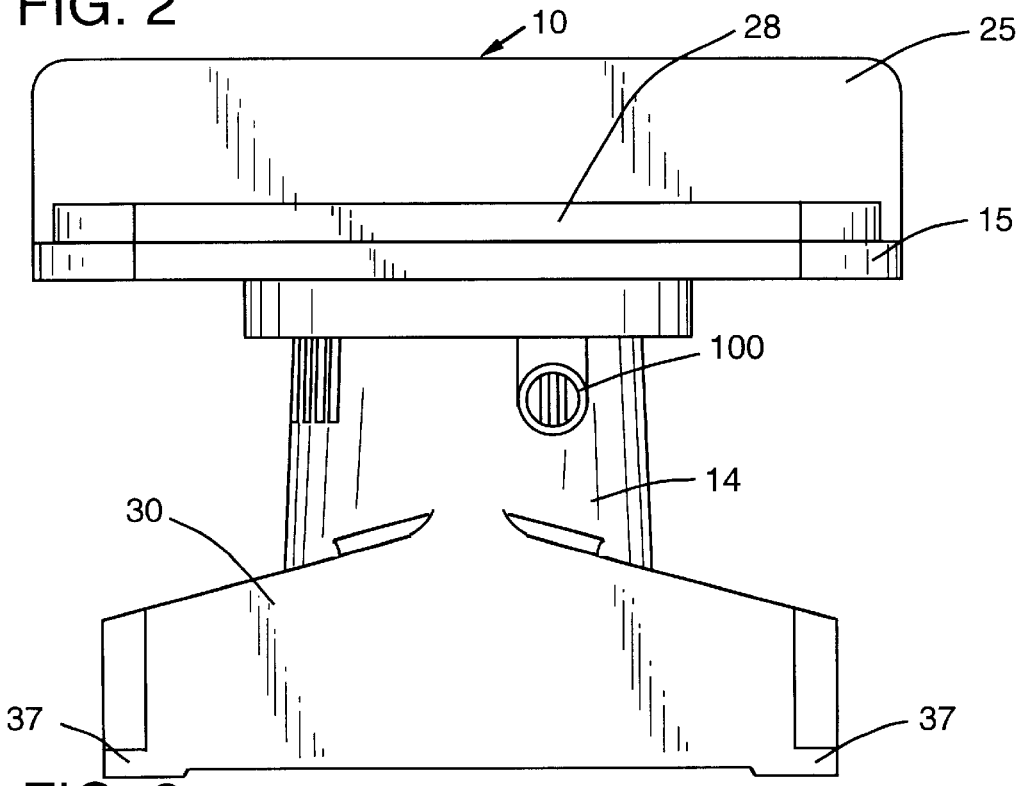
FIG. 3 is a rear elevational view of the embodiment depicted in FIG. 1.

Referring now to the accompanying figures for the purpose of illustrating embodiments of the invention only, and not for the purpose of limiting the same, the several figures show various aspects of a stationary bench-top eccentric orbit sanding device 10 within the scope of the present invention. As shown in particular in FIGS. 1–5, stationary sanding device 10 includes a housing 14 and a workpiece support in the form of a work table 15 for supporting a workpiece (not shown) that is to be abraded. A platen (labeled as 17 in the figures in which it is exposed) having an abrasive sheet 19 fastened to the upper surface thereof is rotatably mounted within the device 10. The abrasive sheet 19 abrades the workpiece as the platen 17 is driven to rotate and orbit, as is further described below. The perimeter of the circular platen 17 may be of any shape, but preferably is circular as shown in the accompanying figures. As further shown in FIG. 1, the platen 17 preferably is positioned so that its upper surface, to which the abrasive sheet 19 is coupled, is generally centrally located on the upper surface of the table 15 and is generally within the plane formed by the upper surface 20 of the work table 15. A collar 22 of a corresponding shape is preferably provided attached to the tablel 5 adjacent the perimeter of the platen 17 so as to form a border between the surface of the table 15 and the surface of the platen 17. The collar 22 fills the gap between the table 15 and the platen 17 and should not extend significantly above the plane of the upper surface 20 of the table 15. The collar 22 thereby prevents the workpiece from striking the exposed edge of the table 15 or from being lodged between the table 15 and the perimeter of the platen 17. The collar 22 preferably is constructed of a resilient material such as, for example, soft plastic or rubber, that will not mar the workpiece if it should contact the collar 22.

Figure 4:
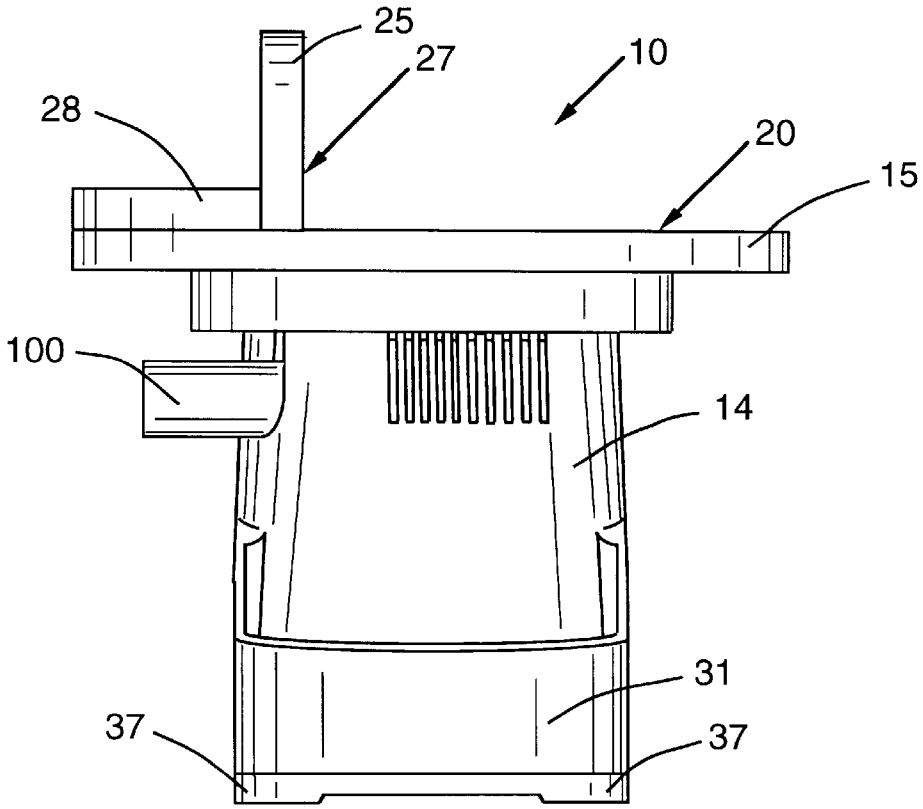
FIG. 4 is a left side elevational view of the embodiment depicted in FIG. 1.
Figure 5:
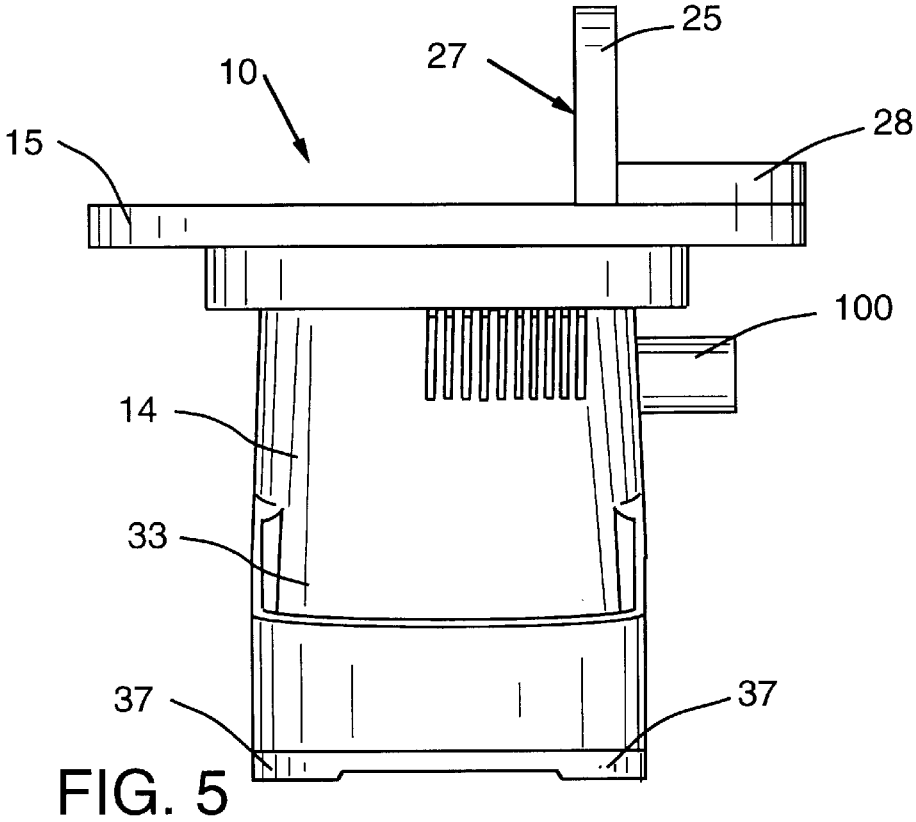
FIG. 5 is a right side elevational view of the embodiment depicted in FIG. 1.

Sanding device 10 also preferably includes a fence 25. As best shown in FIGS. 1, 4, and 5, a surface 27 of the fence 25 preferably is oriented generally perpendicular to the upper surface 20 of the table 15 and lies across the length of the upper surface 20, and the fence 25 also preferably is oriented such that it overlies a portion of platen 17. The surface 27 of the fence 25 may be used to retain a workpiece against the abrasive sheet 19 during sanding, and the perpendicular orientation of the surface 27 also aids in the sanding of 90 degree corners and edges. It will be understood that the inclusion of a fence is optional and, alternately, any other known fence arrangement may be utilized with the sanding device 10 in order to facilitate the accuracy and ease of use of the device 10. Such alternate fence arrangements include, for example, those wherein the angle of the surface 27 relative to the upper surface 20 of the table 15 is adjustable, and also include those fence arrangements wherein the extent by which the platen 17 is overlain by the fence 25 may be adjusted. As shown in FIG. 4, the sanding device 10 also may include a support piece 28 that will reinforce the fence 25 in the proper angle during use. The table 15 and the fence 25 preferably are constructed of materials that will not mar wooden workpieces supported thereby during sanding.

Housing 14 is of sufficient size to fully and independently support the remaining elements of the sanding device 10 on a flat surface such as a table top, workbench, or work stand. As such, in operation the device 10 does not need to be manipulated during sanding and the operator's hands will be entirely free to manipulate the workpiece relative to the driven abrasive sheet 19. Preferably, the base 14 includes two or more support members 30 and 31 to aid in laterally stabilizing the device 10 during sanding. In one preferred arrangement, shown in FIGS. 1–5, support members 30 and 31 are configured so as to form individual trays 33 and 35 that may be used to store accessories for the device 10. It will be understood from a consideration of FIG. 1 that the one or more support members 30 and 31 may be suitably designed to provide a wide base for the device 10 that will inhibit the device from vibrating significantly during use and that will also prevent the device 10 from tipping to either side when force is applied to an end of the table 15. The support members 30 and 31 also each may include one or more foot members 37 on which the weight of the device will be supported. Preferably, the housing 14 and its support members 30 and 31 are positioned so as to support the table 15 and platen 17 in a substantially horizontal orientation when the device 10 is disposed on a horizontal surface. However, additional arrangements (not shown) are possible in which, for example, the table 15 and the platen 17 may be selectively oriented at various angles relative to the surface on which the device is disposed. All such additional arrangements are within the scope of this disclosure.

The internal elements of the embodiment of the invention depicted in the accompanying FIGS. 1–5 and the interrelationship of those elements are shown in accompanying FIGS. 6–15. As particularly shown in the assembly view of FIG. 6 and in the cross-sectional view of FIG. 8, the upper surface of the platen 17 has affixed thereon a transition pad 39 that preferably is constructed so to fixedly receive an undersurface of the abrasive sheet 19. For example, the transition pad 39 may have hooks that detachably yet securely mate with loops on the undersurface of the abrasive sheet 19, or the transition pad 39 may detachably yet securely mate with an adhesive compound resident on the undersurface of the abrasive sheet 19.

Figure 8:
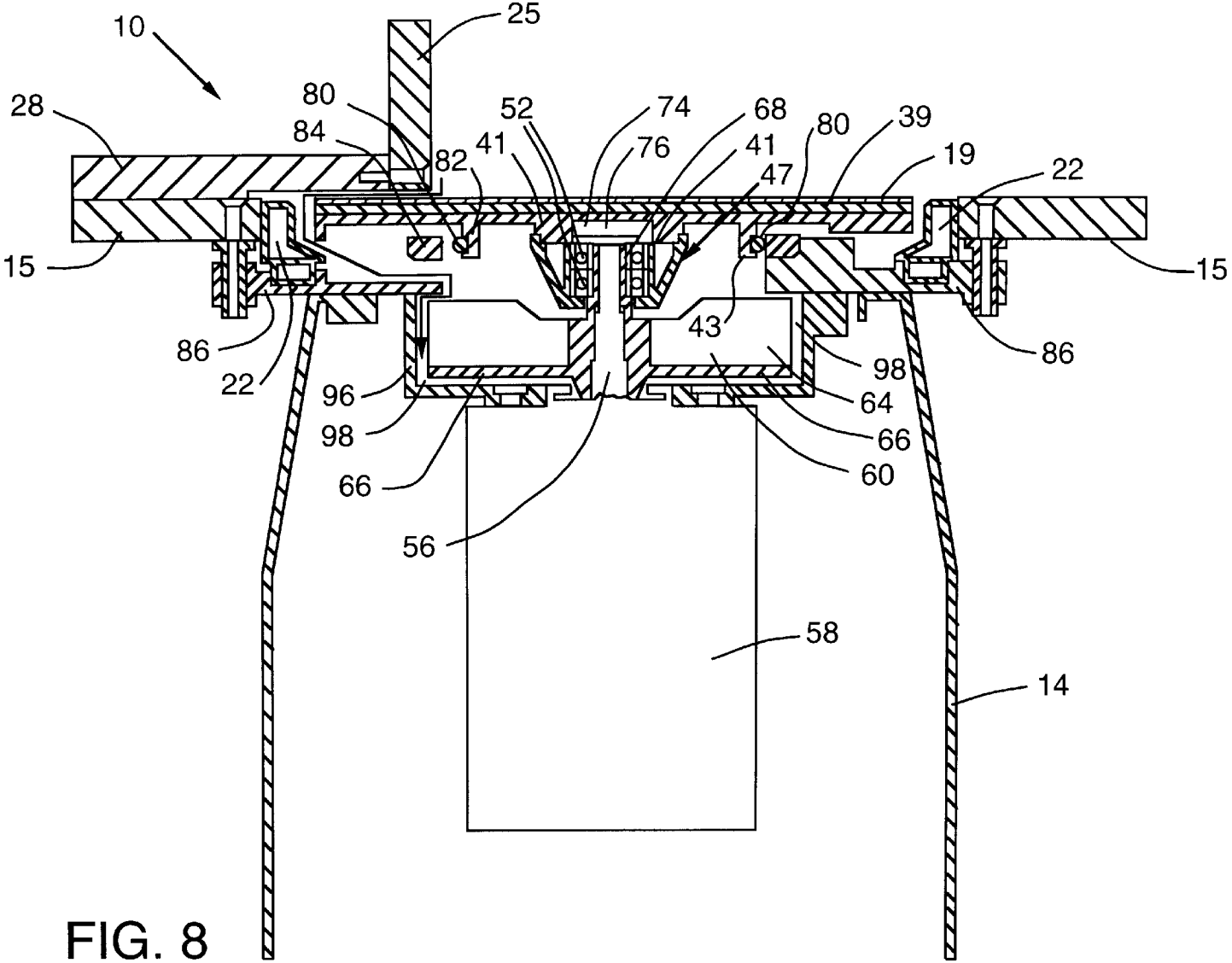
FIG. 8 is a cut-away left side view of the embodiment depicted in FIG. 1 taken along the line VIII—VIII in FIG. 7.
Figure 11:
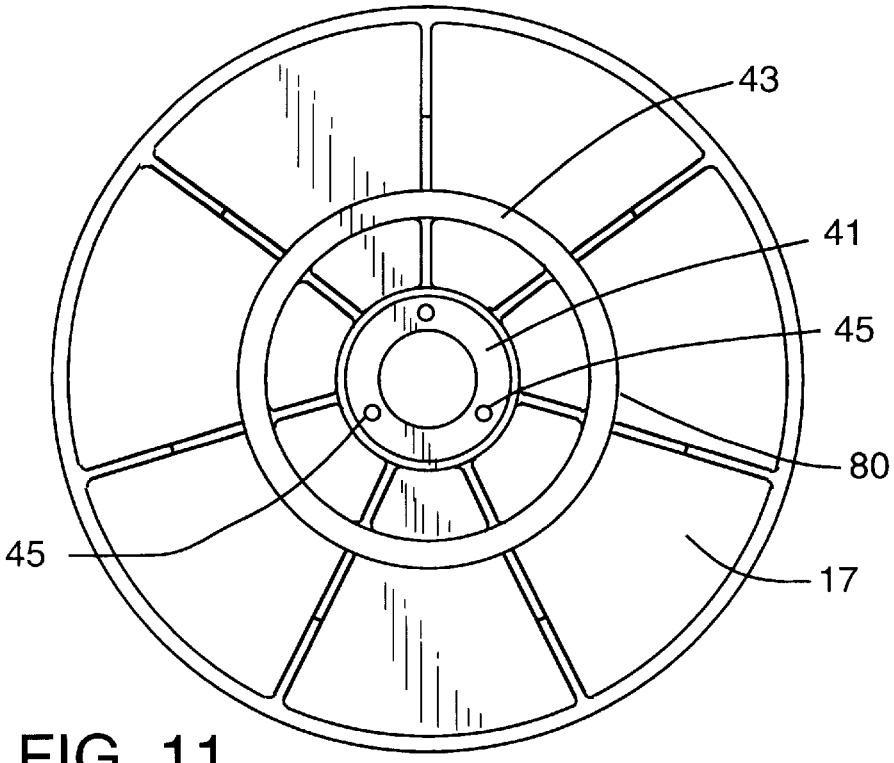
FIG. 11 is a bottom view of the platen of the embodiment depicted in FIG. 1.

As best shown in FIGS. 8 and 11, the undersurface of the platen 17 includes an inner cylindrical raised ring 41 and an outer cylindrical raised ring 43, and the inner and outer raised rings 41 and 43 are concentric. The platen 17 further includes three bores 45 defined entirely through the platen 17 within inner raised ring 41.

Figure 10:
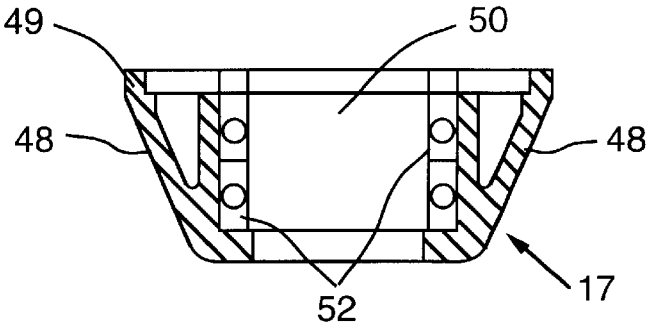
FIG. 10 is a side cut-away view of the platen support depicted in FIG. 9, and taken along the line X—X in FIG. 8.
Figure 9:
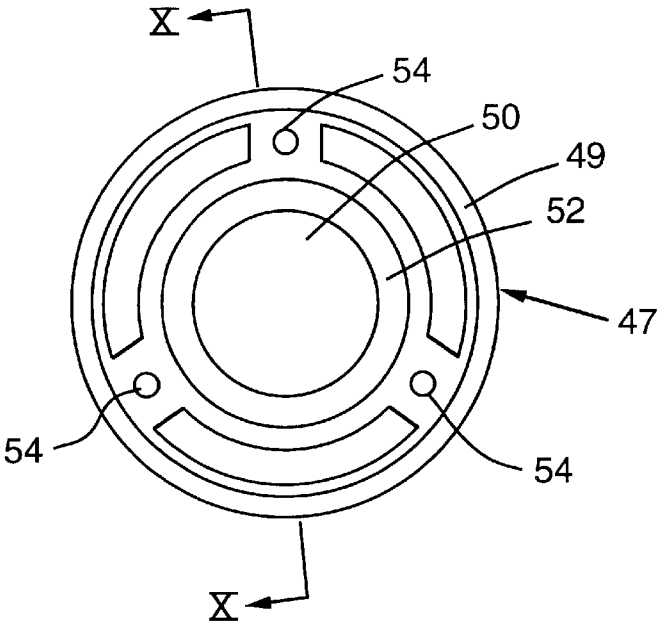
FIG. 9 is a top-view of the platen support of the embodiment depicted in FIG. 1.

The abrading platen 17 is connected to a platen support 47. The platen support 47 is best shown in FIGS. 9 and 10 and includes sloping sides 48 and is generally in the shape of a frustum of a cone. The platen support 47 includes a circular, raised outer rim 49 and a central cylindrical bore 50, and the walls of the bore 50 are defined by a bearing 52 so that a shaft seated within the bore 50 may rotate therein with a reduced level of friction. Platen support 47 further includes three threaded bores 54 defined in a pattern matching that of bores 45 through the platen 17. As illustrated in FIG. 8, the space defined within the rim 49 of the platen support 47 is such that a portion of the inner ring 41 projecting from the undersurface of the platen 17 seats within rim 49. When seated in that fashion, bores 45 through platen 17 align with threaded bores 54 of the platen support 47, and threaded fasteners disposed through the aligned bores fasten the platen 17 to the platen support in device 10. Connected in that arrangement, the central axis of bore 50 of the platen support 47 preferably is substantially coincident with the center point of platen 17.

Figure 16:
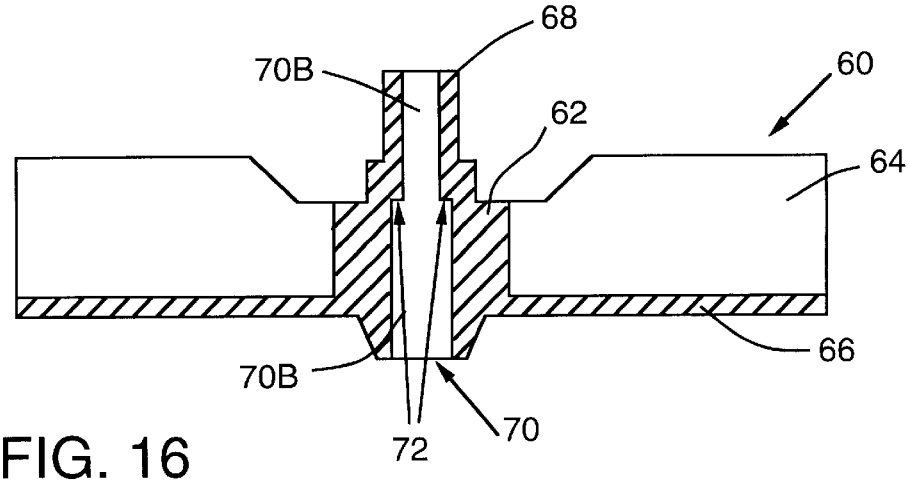
FIG. 16 is a cross-sectional view in isolation of the fan wheel of the embodiment depicted in FIG. 1.

Sanding device 10 further includes a transmission linking movement of a motor shaft 56 of a motor 58, mounted within housing 14, to the platen 17. In order to mount the platen 17 and its attached platen support 47 for rotation about a point and relative to the upper surface 20 of the worktable 15, the transmission includes an intermediate member in the form of a fan wheel 60. As best illustrated in FIG. 8 and in isolation in FIG. 16, fan wheel 60 includes a central hub 62 from which extend laterally several fan vanes 64. The fan vanes 64 are partially supported by a disk-shaped element 66 which also radiates outward from central hub 62. A generally cylindrical spindle 68 projects from the central hub 62 of the fan wheel 60, and the hub 62 and spindle 68 includes a stepped central bore 70 having a lower portion 70A, an upper portion 70B of reduced cross-sectional diameter relative to the lower portion, and a rim 72 defined by the transition from the lower portion 70A to the upper portion 70B of the central bore 70. The upper and lower portions 70B and 70A share an identical central axis. As further described below, bore 70 accepts the elongate cylindrical motor shaft 56 of the motor 58, and the rotation of the shaft 56 is imparted to the fan wheel 60.

Figure 6:
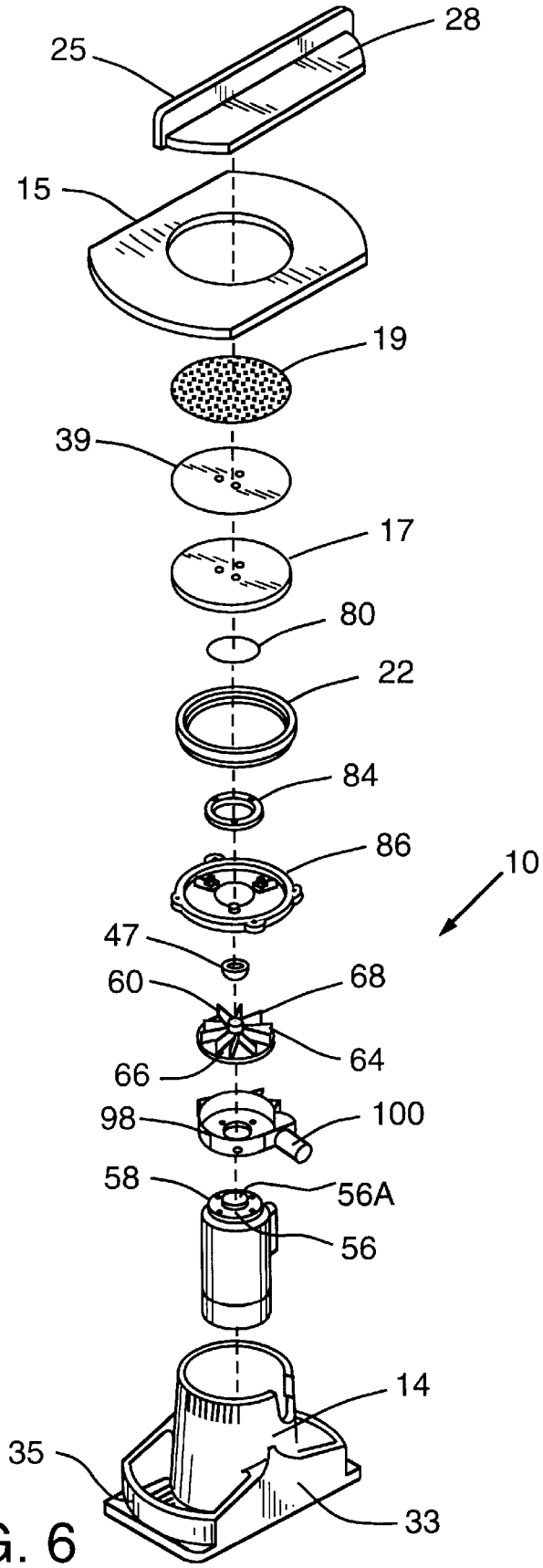
FIG. 6 is an assembly view of the embodiment depicted in FIG. 1.
Figure 7:
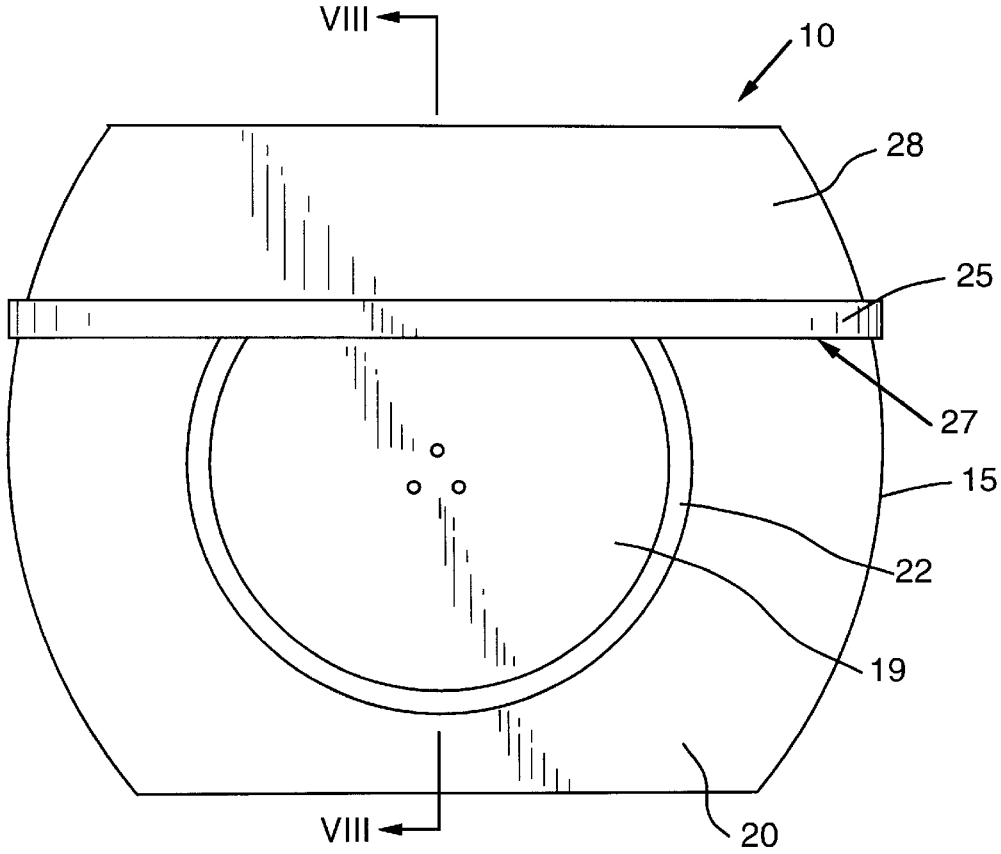
FIG. 7 is a top view of the embodiment depicted in FIG. 1.

As indicated in particular in FIGS. 6 and 8, sanding device 10 includes motor 58 mounted within housing 14 so that the rotatable motor shaft 56 is oriented upward and toward platen 17. Motor shaft 56 may have a configuration that corresponds to the central bore 70 of the fan wheel 60. Thus, motor shaft 56 may have a stepped cylindrical exterior configuration that will closely conform to the separate upper and lower portions 70A and 70B, respectively of central bore 70.

Figure 15:
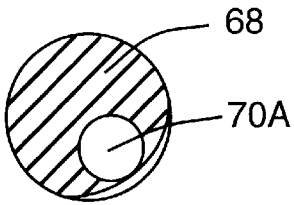
FIG. 15 is a top view of the spindle of the embodiment depicted in FIG. 1.

The combined rotational and orbital motions of platen 17 are provided by the configuration hub 62. As best indicated in FIG. 8, the central axis of the bore 70 in the hub 62 is offset from the central axis of the spindle 68. The arrangement of the upper portion 70B of bore 70 in spindle 68 is represented in FIG. 15, which is a view looking downward onto spindle 68 of the hub 62 as the hub 62 is oriented in FIG. 8. The spindle 68 of the fan wheel is disposed within the central bore 50 of the platen support 47 which in turn is secured to the undersurface of the platen 17. The platen support 47 is secured to spindle 68 by washer 74 and threaded fastener 76, which is disposed through washer 74 and is threadedly secured into upper portion 56A of motor shaft 56, which is correspondingly threaded to accept fastener 76. Washer 74 is sized so as to overlap the bearing 52 and, when secured to spindle 68, prevents platen support 47 from being removed from spindle 68. Thus, it will be understood that the central axis of the spindle 68, which defines the axis of rotation of the platen 17, is offset from the axis of rotation of the spindle 68, which coincides with the central axis of the motor shaft 56. Thus, the axis rotation of the platen 17 is caused to orbit about the axis of rotation of the fan wheel 60, and the platen support 47 and the platen 17 also may rotate about the central axis of spindle 68 on bearings 52. The combination of the simultaneous rotational and orbital motions of the platen 17 results in eccentric rotation of the platen 17 about the central axis of the motor shaft 56. Thus, if the platen 17 were allowed to freely rotate (i.e., absent friction) as it orbits, its rotational rate (i.e., revolutions/minute) would eventually reach its orbital rate (orbits/minute), and the angular directions of rotation and revolution would be the same (i.e., clockwise or counterclockwise).

To prevent the platen 17 from either stalling or reaching too great a rate of rotation, a positive drive feature may be provided in the apparatus 10 to impart positive rotational motion to the platen 17 during operation. The above-described outer raised ring 43 may be considered a first drive member of the positive drive feature. As shown in particular in FIG. 11, the underside of platen 17 includes a resilient ring 80 mounted on the outer perimeter of outer raised ring 43. Resilient ring 80 is therefore centered on the axis formed by the central axis of spindle 68, as is described above. Resilient ring 80 may be formed from an elastic rubber, plastic, or another similarly resilient material, and may be seated in a trough 82 on the outer perimeter of outer raised ring 43. The circumference of resilient ring 80 is preferably slightly smaller than that of trough 82, and, as such, resilient ring 80 may be fitted into trough 82 and held there under elastic tension without the need for additional adhesives or other fastening means and so that the ring 80 experiences little or no independent rotation or slippage relative to trough 82 during operation.

Figure 12:
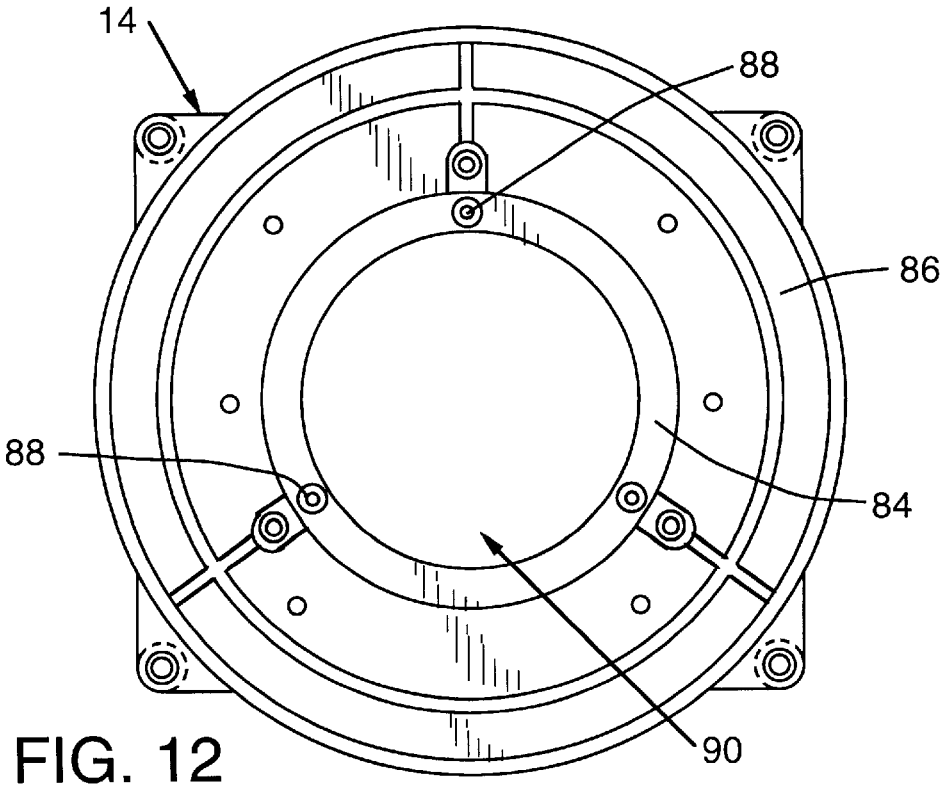
FIG. 12 is a top view of the mounting member and rigid ring of the embodiment depicted in FIG. 1.

As shown in FIG. 6, the positive drive feature further includes a second drive member in the form of a rigid ring 84 that is mounted to a mounting member 86 portion of the housing 14. A top view of the mounting member 86 and the rigid ring 84 attached to the mounting member 86 by fasteners 88 is shown in FIG. 12. As shown in particular in FIG. 12, the rigid ring 84 is fixedly mounted on a surface of the mounting member 86 so that the rigid ring 84 leads into an opening 90 in the mounting member 86. The opening 90 is centered about the axis of motor shaft 56, and the rigid ring 84 is generally concentric about an axis of the motor shaft 56. As shown in particular in FIG. 13, the inner circumference of rigid ring 84 is greater than the outer circumference of outer raised ring 43. When the device 10 is assembled, ring 43 is nested within the interior of rigid ring 84. As such, the two rings 43 and 84 lie substantially in a single plane. However, it will be understood that the central axes of the two rings 43 and 84 are not coincident because their central axes are offset by the distance by which the axis of spindle 68 is offset from the central axis of the motor shaft 56. Such offset is sized so that at least one point on the exposed surface of resilient ring 80 contacts at least one point along the inner circumference of the rigid ring 84 at all times. As such, when the device 10 is in operation and the motor shaft 56 is rotating, fan wheel 60 rotates along with motor shaft 56 and platen 17 orbits on spindle 68 about the axis of rotation of the motor shaft 56. When disc 17 orbits, ring 43 and its resilient ring 80 are caused to roll in an orbit about the inner circumference of the rigid ring 84. The frictional interaction between rigid ring 84 and resilient ring 80 urges the ring 43 (and thus the platen 17 attached thereto) to rotate in a direction of angular movement that is opposite to the direction of angular movement in which the platen 17 would rotate if it were able to freely rotate as it was caused to orbit through its eccentric linkage with the motor shaft 56. Only if the frictional interaction between the resilient ring 80 on the outer circumference of the ring 43 and the inner circumference of the rigid ring 84 is overcome, and a slippage in the relative rolling motion of the two rings 43 and 84 occurs, will the rotation of the abrading platen 17 set up by the positive drive feature be retarded.

Although a resilient ring 80 is included in the present embodiment, it will be understood that if rings 43 and 84 are constructed of appropriate materials such a resilient ring 80 may not be needed to provide adequate frictional interaction between the rings 43 and 84. For example, one of the rings may be constructed of a hard rubber material that frictionally contacts the remaining ring, or both rings 43 and 84 may be constructed of the hard rubber material.

Figure 13:
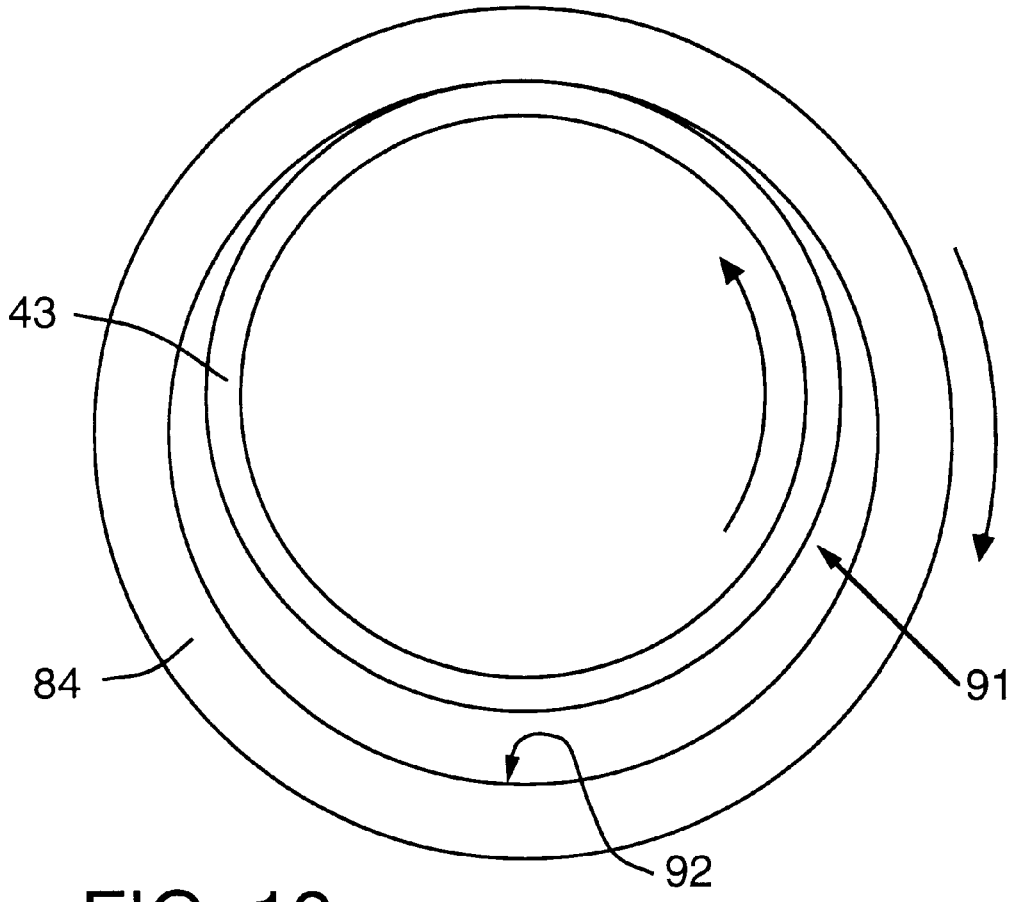
FIG. 13 a schematic representation of the interaction between the outer cylindrical raised ring and rigid ring of the embodiment depicted in FIG. 1.

An example of the relative movement of the rings 43 and 84 as the motor shaft 56 rotates is provided in FIG. 13, which is a view looking downward onto the motor, which would be disposed beneath the plane of the paper. For clarity, FIG. 13 excludes resilient ring 80 from the outer perimeter of ring 43. As the motor shaft rotates in a clockwise direction, the outer circumference 91 of the ring 43 rolls relative to the inner circumference 92 of the ring 84 in the clockwise angular direction of the external arrow. This rolling motion causes the ring 43 to rotate in the opposite angular direction (counterclockwise), indicated by the internal arrow.

It will be understood that in certain conditions of use sufficient force may be applied to the surface of the platen 17 to upset the relative rolling motion of the two rings 43 and 84 and cause ring 43 to slip relative to ring 84. It will further be understood that the threshold force at which such slippage between rings 43 and 84 occurs can be increased, or such slippage possibly may be entirely prevented, by excluding resilient ring 80 and, instead, providing the outer circumference 91 of the ring 43 and the inner circumference 92 of the rigid ring 84 with corresponding sets of geared teeth. As such, the teeth on ring 43 would be caused to interlock with the teeth on the rigid ring 84 and the ring 43 would orbit about the inner circumference of the rigid ring 84. In such an embodiment (not shown), the mechanical linkage provided by the intermeshing teeth would have to be overcome before any slippage would occur between the two rings 43 and 84. Other alternate arrangement for providing positive rotation of the platen 17 as the motor shaft 56 rotates will be apparent to those of ordinary skill in the art upon consideration of the present description of the invention.

The present embodiment 10 additionally may incorporate a dust collection feature. As indicated in FIG. 8, the fan wheel 60 is nested within a cylindrical air guide cylinder 96 that defines the walls of an air guide cavity 98 that is in communication with the upper surface 20 of the work table 15. The fan wheel 60 is provided with a plurality of radially emanating vanes 64. In operation, the fan wheel 64 rotates along with the motor shaft 56, and the vanes 64 create a partial vacuum within the air guide cavity 98 by forcing air within the air guide cavity 98 out through exhaust port 100, which communicates the air guide cavity 98 with the atmosphere exterior to the housing 14. Dust and other abraded matter from the abrading process, pulled to the edge of the abrading platen 17 by centrifugal force, is drawn by the partial vacuum into the housing and into the air guide cavity 98 as indicated generally by the arrow in FIG. 8, and is expelled through the exhaust port 100. It will be understood that the exhaust port 100 optionally may be connected to a dust collection device or chamber as are known in the art as a means to collect the dust.

Figure 14:
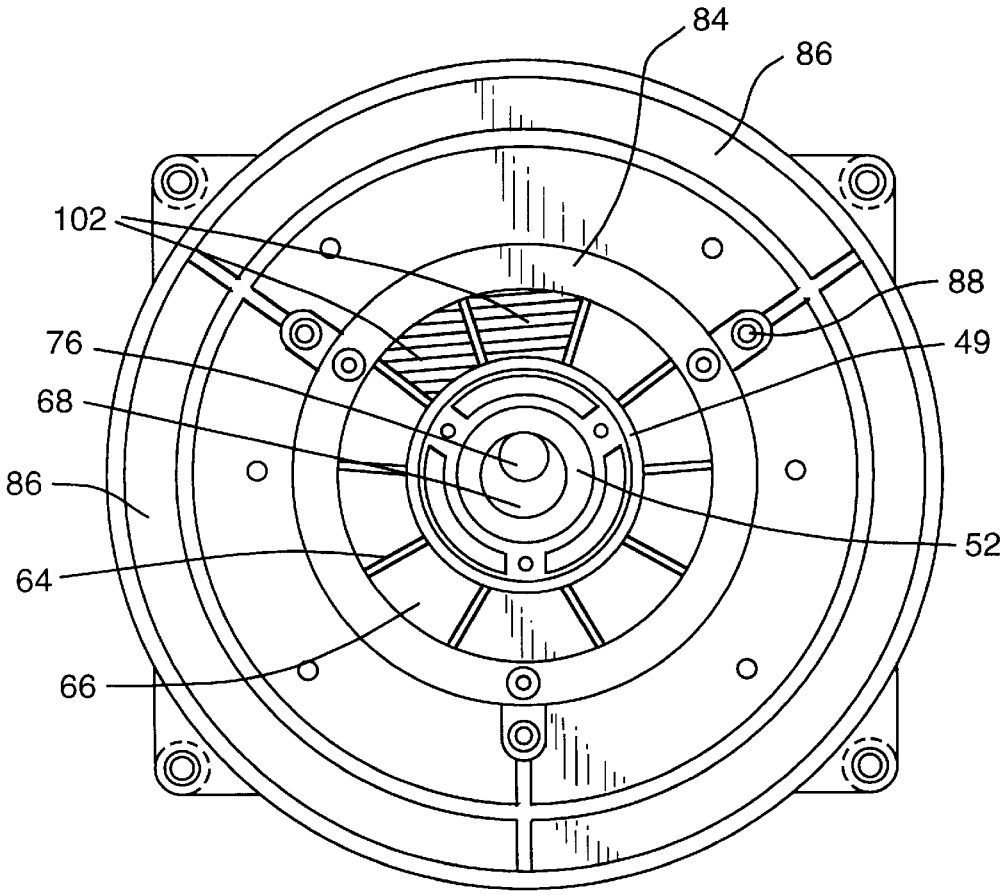
FIG. 14 is a top view of the embodiment of FIG. 1 showing the device with the workpiece support and platen removed and particularly showing the arrangement of elements within the opening in the mounting member of the housing.

The oscillation of the abrading platen 17 may create a vibration force. Accordingly, as shown in particular in FIG. 14, one or more counterbalance weights may be mounted as needed on the fan wheel 60, or on other elements of the device 10, to counteract the vibrations. In the present embodiment, two weights 102 are shown positioned between vanes 64 on the surface of the fan wheel 60. In one manner to counteract vibrational forces, the weights may be symmetrically disposed about a line connecting the axes of spindle 68 and motor shaft 56 as is indicated in FIG. 14.

Those of ordinary skill in the art will, of course, appreciate that various changes in the details, materials and arrangements of parts which have been herein described and illustrated in order to explain the nature of the invention may be made by those skilled in the art within the principle and scope of the invention as expressed in the appended claims.

What is claimed is:

1. An abrading apparatus comprising:

a housing comprising a base adapted to support said housing on a surface;

a workpiece support member mounted on said housing;

a motor mounted within said housing and comprising a motor shaft, said motor shaft selectively rotatable about a first rotational axis;

a platen; and a transmission, said transmission transmitting rotation of said motor shaft to said platen so that as said motor shaft rotates, said platen is urged to rotate about a second rotational axis that is offset from and orbits about said first rotational axis.

2. The abrading apparatus of claim 1 wherein said first rotational axis and said second rotational axis are generally parallel.

3. The abrading apparatus of claim 2 wherein said transmission comprises an intermediate member connected to said motor shaft and rotatable about said first rotational axis as said motor shaft rotates, said intermediate member comprising a mounting structure defining said second rotational axis.

4. The abrading apparatus of claim 3 wherein said mounting structure comprises a spindle, said platen operably mounted and rotatable on said spindle so that an axis of said spindle defines said second rotational axis.

5. The abrading apparatus of claim 4 wherein said intermediate member includes a motor shaft mounting bore for accepting at least a portion of said motor shaft to thereby connect said motor shaft to said intermediate member, an axis of said motor shaft mounting bore coincident with said first rotational axis, said motor shaft mounting bore extending into said spindle, said spindle configured so as to define a central axis thereof that is coincident with said second rotational axis.

6. The abrading apparatus of claim 5 wherein the perimeter of a cross-section of said spindle is generally circular, said abrading apparatus further comprising a platen support mounting said platen on said spindle, said platen support being connected to said platen and defining a spindle receiving bore, at least a portion of said spindle being disposed within said spindle receiving bore, said platen support rotatable about said spindle.

7. The abrading apparatus of claim 6 further comprising at least one friction reduction member mounted on at least one of said platen support and said spindle facilitating rotation of said platen support about said spindle.

8. The abrading apparatus of claim 7 wherein said friction reduction member is a roller bearing mounted within said spindle receiving bore of said platen support.

9. The abrading apparatus of claim 6 further comprising:

a first ring having a generally circular inner perimeter, said first ring fixedly mounted on said base and having a central axis generally coincident with said first rotational axis; and a second ring having a generally circular outer perimeter, said second ring fixedly mounted on said platen and having a central axis generally coincident with said second rotational axis, said inner perimeter of said first ring being greater than said outer perimeter of said second ring, said second ring positioned within and rolling along said inner perimeter of said first ring, at least a point on said outer perimeter of said second ring contacting said inner perimeter of said first ring as said second rotational axis orbits about said first rotational axis to thereby urge said platen to rotate about said second rotational axis in an angular direction opposite to an angular direction of rotation of said first rotational axis.

10. The abrading apparatus of claim 9 wherein at least one of said first ring and said second ring comprises a frictional member inhibiting slippage between said first ring and said second ring as said outer perimeter of said second ring rolls about said inner perimeter of said first ring.

11. The abrading apparatus of claim 10 wherein said second ring comprises said frictional member and wherein said frictional member is comprised of a resilient material.

12. The abrading apparatus of claim 6 wherein said intermediate member further comprises a plurality of radially disposed vanes, said vanes disposed within an air guide cavity within said housing, said air guide cavity in communication with said workpiece support surface and comprising an exhaust port exiting said air guide cavity.

13. The abrading apparatus of claim 12 wherein rotation of said intermediate member about said first rotational axis forces air through said exhaust port and provides a reduction in pressure within said air guide cavity, said reduction in pressure pulling air from a region surrounding said workpiece support surface into said air guide cavity and through said exhaust port.

14. The abrading apparatus of claim 13 wherein said reduction in pressure within said air guide cavity urges a portion of abraded material resident on said workpiece support surface into said air guide cavity and through said exhaust port to a location exterior of said housing.

15. The abrading apparatus of claim 1 wherein said platen further comprises an abrasive member mounting surface mounting on said platen an abrasive member comprising an abrasive surface.

16. The abrading apparatus of claim 15 further comprising an abrasive member, said abrasive member comprising an abrasive surface and being mounted on said abrasive member mounting surface of said platen.

17. The abrading apparatus of claim 16 wherein said workpiece support member borders at least a portion of said platen, a workpiece supporting surface of said workpiece support member being generally coplanar with said abrasive surface of said abrasive member.

18. The abrading apparatus of claim 1 further comprising a fence member mounted on said workpiece support member, said fence member comprising a fence surface.

19. The abrading apparatus of claim 18, wherein an angle formed by said fence surface and a surface of said workpiece support member is adjustable between at least first and second angles.

20. An abrading apparatus comprising:

a base adapted to support the abrading apparatus on a surface;

a housing connected to said base;

a workpiece support member mounted on said housing;

a motor connected to said housing, said motor comprising a motor shaft rotatable about a first axis of rotation;

a platen rotatable about a second axis of rotation, said second axis of rotation differing from said first axis of rotation, said platen coupled to said motor shaft by a transmission, said transmission orbiting said second axis of rotation in a circular path about said first axis of rotation as said motor shaft rotates.

21. The abrading apparatus of claim 20 wherein said first axis of rotation is generally parallel to said second axis of rotation.

22. The abrading apparatus of claim 20 wherein said transmission comprises an intermediate member rotatably mounting said platen thereto, said intermediate member configured to fixedly connect to said motor shaft.

23. The abrading apparatus of claim 22 wherein said transmission comprises an intermediate member comprising a spindle, said platen including a bore accepting said spindle and being rotatable on said spindle, an axis of said spindle defining said second axis of rotation.

24. The abrading apparatus of claim 23 wherein said intermediate member further comprises means for fixedly connecting said intermediate member to said motor shaft.

25. The abrading apparatus of claim 23 wherein said intermediate member comprises a bore accepting said motor shaft to thereby fixedly connect said intermediate member to said motor shaft.

26. The abrading apparatus of 23 wherein said platen further comprises a platen support, said platen support defining said bore accepting said spindle.

27. The abrading apparatus of claim 20 further comprising a positive drive system urging said platen to rotate in a second angular direction on said second axis of rotation as said motor shaft rotates on said first axis of rotation in a first angular direction, said first angular direction of rotation being opposite to said second angular direction of rotation.

28. The abrading apparatus of claim 27 wherein said positive drive system comprises:

a first drive member defining an inner void of a generally circular perimeter, said first drive member fixedly connected to said base, said inner void having a central axis generally coincident with said first axis of rotation; and a second drive member, said second drive member having a generally circular outer perimeter and being fixedly mounted on said platen, said second drive member having a central axis generally coincident with said second axis of rotation, said generally circular perimeter of said inner void of said first drive member being greater than said generally circular outer perimeter of said second drive member, said second drive member positioned within said inner void and capable of rolling along said generally circular perimeter of said inner void as said second axis of rotation orbits about said first axis of rotation.

29. The abrading apparatus of claim 28 wherein at least a point on said generally circular outer perimeter of said second drive member contacts said generally circular perimeter of said inner void of said first drive member as said second axis of rotation orbits about said first axis of rotation to thereby urge said platen to rotate on said second axis of rotation in an angular direction opposite to an angular direction of rotation of said motor shaft on said first axis of rotation.

30. The abrading apparatus of claim 29 wherein said first drive member and said second drive member are generally ring-shaped.

31. The abrading apparatus of claim 29 wherein at least one of said first drive member and said second drive member comprises a frictional member inhibiting slippage between said first drive member and said second drive member as said generally circular outer perimeter of said second drive member rolls about said generally circular inner perimeter of said first drive member.

32. The abrading apparatus of claim 20 further comprising means for removing abraded material from said workpiece support surface.

33. The abrading apparatus of claim 20 further comprising an intermediate member operably connected to said motor shaft and rotating with said motor shaft about said first axis of rotation, said intermediate member including at least one vane and being disposed within an air guide cavity within said housing, said air guide cavity communicating with a surface of said platen, said air guide cavity further comprising an exhaust port exiting said air guide cavity, rotation of said intermediate member creating an airflow drawing abraded material disposed on said surface of said platen into said air guide cavity and through said exhaust port.

34. An abrading apparatus for abrading material from a workpiece, the abrading apparatus comprising:

a housing;

a base connected to said housing, said base adapted to support said housing on a surface so that an operator may abrade material from the workpiece without the need to manipulate a position of the abrading apparatus;

a rotatable platen;

a workpiece support connected to said housing;

a motor mounted on said housing, said motor comprising a motor shaft rotatable about a first axis of rotation; and a transmission connected to said platen and said motor shaft said transmission transmitting rotation of said motor shaft to said platen, said platen rotatable about a second axis of rotation defined by said transmission, said second axis of rotation offset from said first axis of rotation, said second axis of rotation orbiting about said first axis of rotation as said motor shaft rotates.

35. The abrading apparatus of claim 34 wherein said housing comprises said base.

36. The abrading apparatus of claim 34, further comprising means for urging said platen to rotate about said second axis of rotation in a first direction of angular motion as said motor shaft rotates about said first axis of rotation in a second direction of angular motion, said first direction of angular motion being opposite to said second direction of angular motion.

37. The abrading apparatus of claim 36 wherein said first direction of angular motion is clockwise and said second direction of angular motion is counterclockwise.

38. The abrading apparatus of claim 36 wherein said first direction of angular motion is counterclockwise and said second direction of angular motion is clockwise.

39. The abrading apparatus of claim 34, further comprising dust collection means for removing from at least one of said platen and said workpiece support surface at least a portion of a material abraded from the workpiece.

40. An abrading apparatus for abrading material from a workpiece, the abrading apparatus comprising:

a housing;

means for positioning said housing on a surface;

a workpiece support connected to said housing;

a platen rotatable about an axis of rotation;

a motor connected to and at least substantially enclosed by said housing and comprising a rotatable motor shaft; and a transmission linking said motor shaft and said platen, said transmission urging said axis of rotation of said platen to orbit about a point as said motor shaft rotates.

41. The abrading apparatus of claim 40 wherein said point lies on a line that is coincident with an axis of rotation of said motor shaft.

* * * * *